US009139339B2

(12) United States Patent
Pang et al.

(10) Patent No.: US 9,139,339 B2
(45) Date of Patent: Sep. 22, 2015

(54) EASY OPEN APPARATUS AND METHOD FOR MULTI-PLY BAGS

(71) Applicant: Standard Multiwall Bag Manufacturing Co., Beaverton, OR (US)

(72) Inventors: Yuming Pang, Beaverton, OR (US); Paul Lin, Beaverton, OR (US)

(73) Assignee: Standard Multiwall Bag Manufacturing Co., Beaverton, OR (US)

( * ) Notice: Subject to any disclaimer, the term of this patent is extended or adjusted under 35 U.S.C. 154(b) by 8 days.

(21) Appl. No.: 14/211,352

(22) Filed: Mar. 14, 2014

(65) Prior Publication Data

US 2014/0270598 A1 Sep. 18, 2014

Related U.S. Application Data

(60) Provisional application No. 61/794,798, filed on Mar. 15, 2013.

(51) Int. Cl.

| | |
|---|---|
| ***B65D 30/08*** | (2006.01) |
| ***B65D 30/18*** | (2006.01) |
| ***B65D 75/68*** | (2006.01) |
| ***B65D 33/22*** | (2006.01) |

(52) U.S. Cl.

CPC ..... *B65D 31/04* (2013.01); *B65D 31/08* (2013.01); *B65D 33/22* (2013.01); *B65D 75/68* (2013.01); *Y10T 156/1051* (2015.01); *Y10T 156/1064* (2015.01)

(58) Field of Classification Search

CPC .... B65D 75/66; B65D 75/68; B65D 75/5838; B65D 75/58; B65D 75/5805; B65D 75/5816; B65D 75/30; B65D 75/5822; B65D 33/26; B65D 33/28; B65D 31/04; A65B 61/188; B31B 19/84; B31B 2219/90678; B31B 2219/9019; B31B 37/00; B31B 37/23; B31B 2237/10

USPC ..... 383/200, 205–208, 109, 111, 113–115, 383/66; 493/162, 177, 178, 183, 184, 195, 493/213

See application file for complete search history.

(56) References Cited

U.S. PATENT DOCUMENTS

| | | | | | |
|---|---|---|---|---|---|
| 2,969,292 | A | * | 1/1961 | Heller | 426/113 |
| 3,098,601 | A | * | 7/1963 | Anderson et al. | 383/205 |
| 3,187,982 | A | * | 6/1965 | Underwood et al. | 229/205 |
| 3,197,120 | A | * | 7/1965 | Sparks | 383/206 |
| 3,245,525 | A | * | 4/1966 | Shoemaker | 206/249 |
| 3,301,687 | A | * | 1/1967 | Davy | 426/113 |
| 3,352,480 | A | * | 11/1967 | Forman | 206/497 |
| 3,362,617 | A | * | 1/1968 | Francis | 229/87.05 |
| 3,494,538 | A | * | 2/1970 | Matthews | 206/481 |
| 3,565,328 | A | * | 2/1971 | Hudson | 383/205 |

(Continued)

*Primary Examiner* — Jes F Pascua
*Assistant Examiner* — Peter Helvey
(74) *Attorney, Agent, or Firm* — Hancock Hughey LLP

(57) ABSTRACT

An easy open apparatus for multi-wall bags and a method for making such bags are disclosed. The bag has a closed end and an open end and the rear panel is stepped relative to the upper edge of the front panel. A tear-tape strip is adhered to an inner surface of a flap formed in the outer layer of the front panel and extends partly across the panel with ends of the tear-tape exposed. To open the bag, the user grasps one exposed end of the tear-tape and pulls it outwardly away from the bag, thereby tearing the outer paper layer across the flap to form a "pocket" or "handle" that the user may grasp to tear the bag open.

20 Claims, 4 Drawing Sheets

(56) References Cited

U.S. PATENT DOCUMENTS

| | | | | | |
|---|---|---|---|---|---|
| 3,850,366 | A | * | 11/1974 | Saito | 83/206 |
| 4,301,925 | A | * | 11/1981 | Bogart | 383/203 |
| 4,364,478 | A | * | 12/1982 | Tuns | 383/205 |
| 4,558,785 | A | * | 12/1985 | Gordon | 229/235 |
| 4,567,987 | A | * | 2/1986 | Lepisto et al. | 383/205 |
| 4,629,071 | A | * | 12/1986 | Tani | 383/206 |
| 4,650,079 | A | * | 3/1987 | Tani | 383/206 |
| 4,773,541 | A | * | 9/1988 | Riddell | 229/235 |
| 4,946,289 | A | * | 8/1990 | Bolling et al. | 383/204 |
| 5,116,140 | A | * | 5/1992 | Hirashima | 383/206 |
| 5,836,697 | A | * | 11/1998 | Chiesa | 383/205 |
| 2005/0063624 | A1 | * | 3/2005 | Goto et al. | 383/205 |
| 2005/0111765 | A1 | * | 5/2005 | Beaulieu | 383/205 |
| 2007/0228040 | A1 | * | 10/2007 | Boriani et al. | 220/62.2 |

* cited by examiner

EASY OPEN APPARATUS AND METHOD FOR MULTI-PLY BAGS

TECHNICAL FIELD

The invention relates to multi-ply bags such as a 3 ply block bottom bag, and more particularly to an easy open system for such bags.

BACKGROUND INFORMATION

Multi-wall bulk bags are very commonly used for bulk storage and shipment of a wide variety of materials such as dry food products, powdered milk and whey and the like. And there are many different sizes and styles of such bulk bags, which are sometimes called flexible intermediate bulk containers. For example, multi-wall bulk bags are available with two or more layers, and many such bags include a plastic liner as the innermost layer. One typical type of a bulk multi-wall bag has an outer layer of heavy paper such as kraft paper, a middle ply of paper, an inner ply of paper and a plastic liner that is often laminated to the inner paper layer. One end of the bag is closed, and "block bottom" and "pinch" closures are fairly standard and conventional. The opposite end of the bag remains open when the bag is originally manufactured. The open end is closed and sealed by the end user after the bag has been filed.

In use, the empty bag is filled by the customer with the bulk material and, once filled, the open end is closed to make the bag ready for shipment and storage. There are many different ways that the open end of a filled bag may be closed. Regardless of what type of closure is used, a common and important aspect of the closure is that the closure must define a complete seal so that the integrity and product life of the contents of the bag is enhanced. Both pinch-top and stitched-top bags are very conventional. A pinch-top closure is a type of closure where the layers of the bag are pinched together and heated to seal the open end. A stitched-top bag typically has a tape folded over the upper edges of the bag and stitching extending laterally across the tape. There are several different stitching styles used, and chain and over lock stitching patterns are common examples. There are additional types of closure systems for the open end of bulk bags. For instance, the bag described herein and according to the present invention utilizes a closure defined by a stepped flap that extends from the back panel of the bag, and which is folded over the front panel of the bag and then sealed to the front panel to complete the closure.

Regardless of the type of closure that is used, the end user must open the closed top end of the bag to access its contents. How the bag is opened typically depends on the type of closure. For example, with a pinch-top closure the end user often uses a sharp knife to open the bag—a slit is made laterally across the bag near the upper edge and through the layers of the bag. With a stitched-top bag, it is often possible to pull the stitching out by pulling a specific thread used in the stitch pattern. Some bags incorporate "easy-open" features that allow the user to open the bag without a knife, and without pulling stitching. Often, these easy-open features are incorporated into cover sheets called patches that are glued onto and cover the folded bottom ends of the outer paper layer during manufacture. The user tears off the patches to allow access to the contents of the bag.

Despite the availability of many different sizes and styles of bulk material bags, including such bags with easy open features, there is a need in the industry for bags that facilitate reliable and fast opening by the end user. Using knives to open bags brings inherent dangers of the user being injured. Tearing out chain lock stitching can be problematic and does not always allow for quick opening.

The present invention is an easy open apparatus and system for bulk material bags that overcomes the problems typically associated with existing bags. The invention is illustrated in FIGS. 1 through 6, which may also be taken as a sequence of drawings that illustrate the steps utilized to assemble the easy open apparatus according to the invention.

The invention comprises an easy open apparatus and system for multi-wall bags and a method for making such bags. The invention is illustrated and described herein in respect of a 3 play block bottom bag. However, it will be readily appreciated that the easy opening feature may be incorporated into a variety of different types of bulk bags.

BRIEF DESCRIPTION OF THE DRAWINGS

The invention will be better understood and its numerous objects and advantages will be apparent by reference to the following detailed description of the invention when taken in conjunction with the following drawings.

Figure 2:
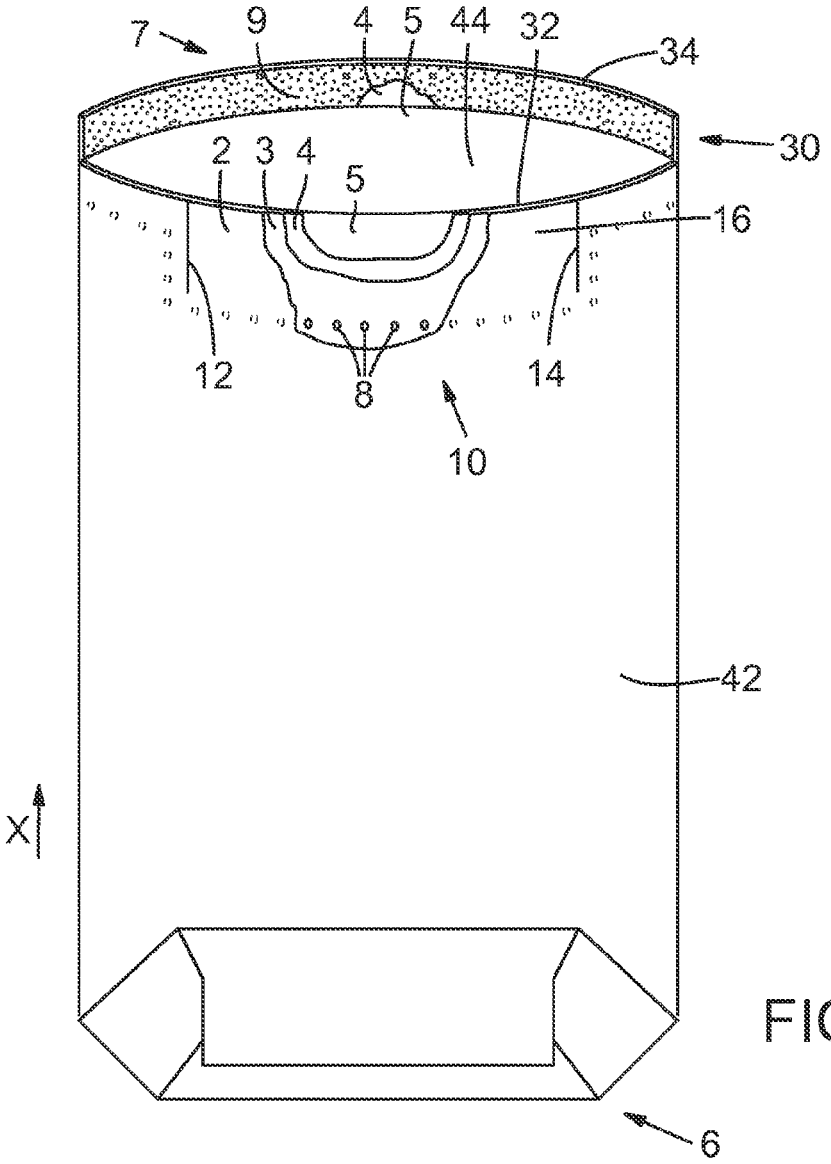
FIGS. 2 through 6 are a sequential series of views illustrating each step in the method of incorporating an easy open apparatus in a bulk material bag.

Specifically:

FIG. 2 is an elevation view of a multi-layer bulk material bag of the type that may incorporate the easy open apparatus according to the present invention, in which the easy open apparatus has not yet been added to the bag; in FIG. 2 part of the bag is shown in cut away view.

Figure 3:
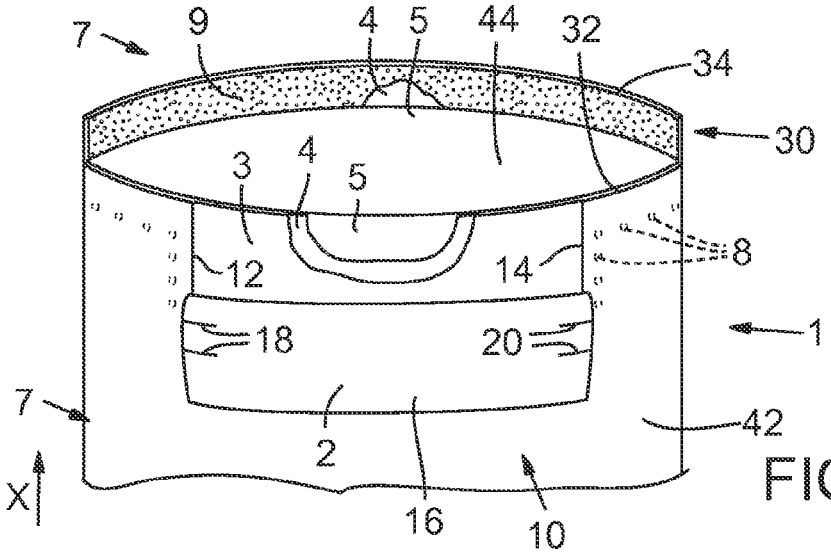

FIG. 3 is an elevation view of the upper, open end of the bag shown in FIG. 2, illustrating the next sequential step in the process of adding the easy open apparatus and again showing part of the bag in a cut away view.

Figure 4:
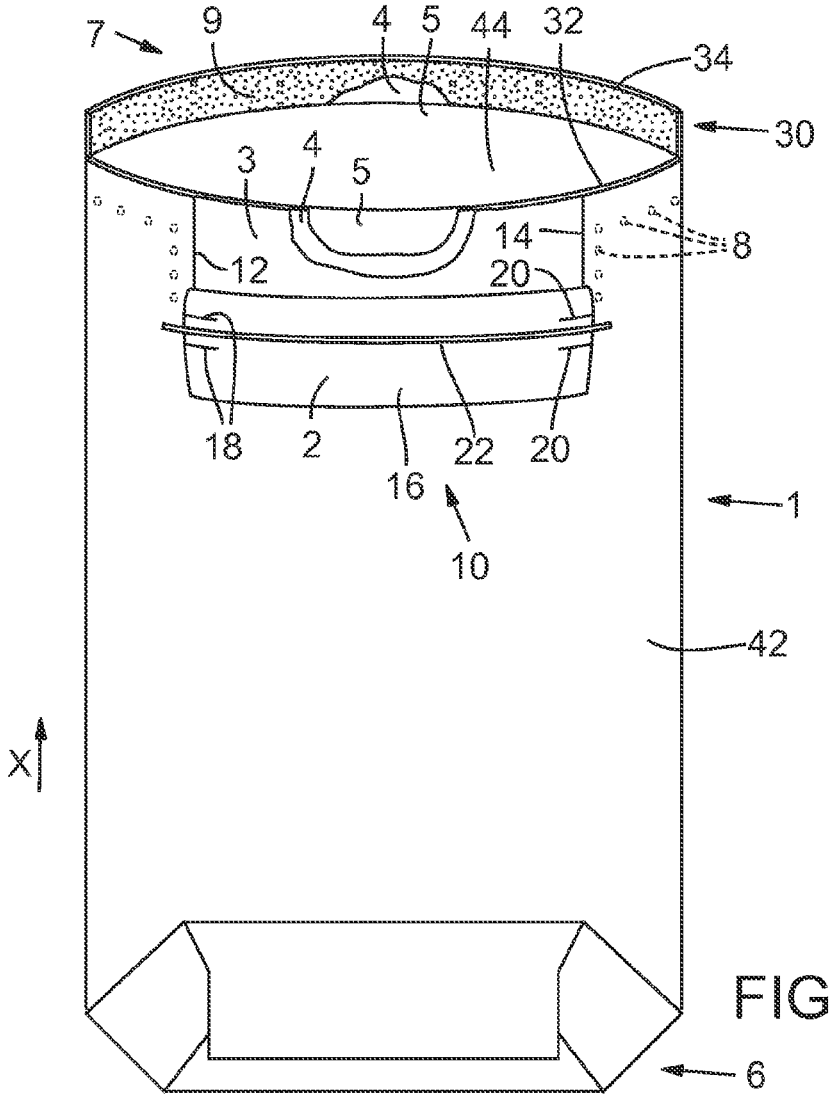

FIG. 4 is an elevation view of the bag of FIG. 2 showing the next step in the process of adding the easy open apparatus.

Figure 5:
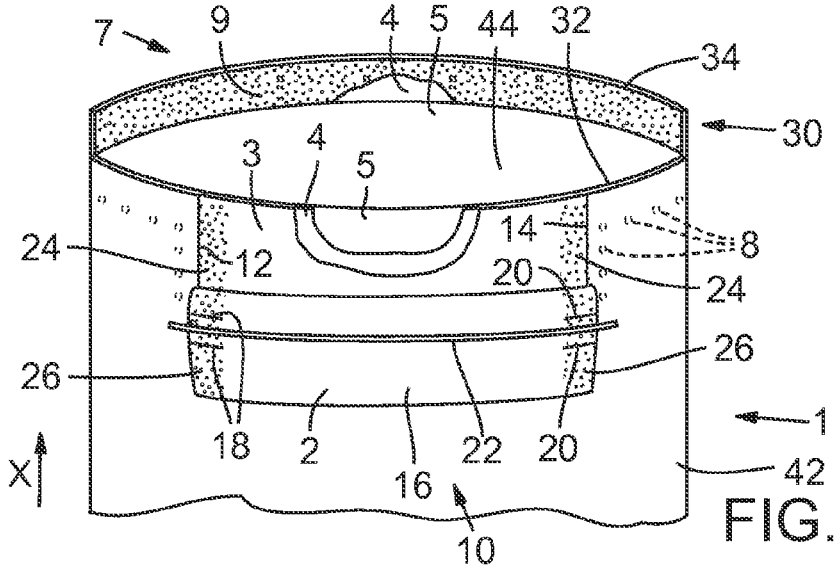

FIG. 5 is an elevation view similar to FIG. 3 showing the next sequential step from FIG. 4.

Figure 6:
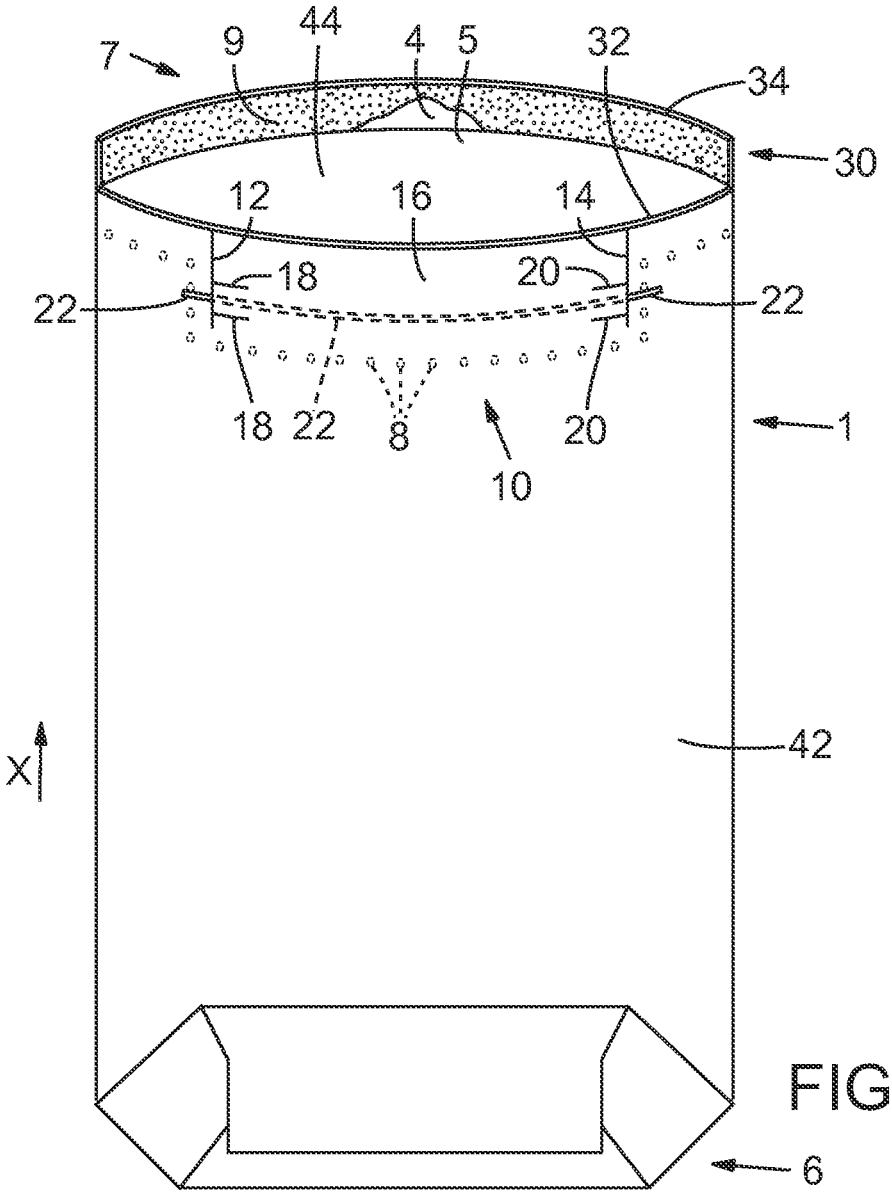

FIG. 6 is an elevation view of a finished, empty bulk material bag that incorporates an easy open apparatus according to the present invention; the bag illustrated in FIG. 6 is ready to be sent to the consumer for filling.

DETAILED DESCRIPTION OF ILLUSTRATED EMBODIMENTS

A multi-layer bulk material bag that incorporates an easy open apparatus according to the invention is shown in the drawings. The bag shown in FIGS. 1 through 6 is embodied in a 3 ply block bottom bag identified generally with reference number 1. It will be appreciated that the invention is not limited to such bag construction with three plies and a block bottom, but may instead be incorporated into a variety of different bag types; the bag 1 described herein and illustrated in the drawings is intended to illustrate but not limit the scope of the invention.

At times in this description, various relational directional terms are used to describe structural features of the invention and their relative locations. Directional terms correspond generally to the orientation of the bag 1 shown in FIG. 1, with the term "upper" referring to the top of the bag and the term "lower" referring to the opposite direction—toward the block bottom. "Inward" is the direction from the exterior of the bag toward the interior of the bag, and outward is the generally opposite direction, and so on.

Figure 1:
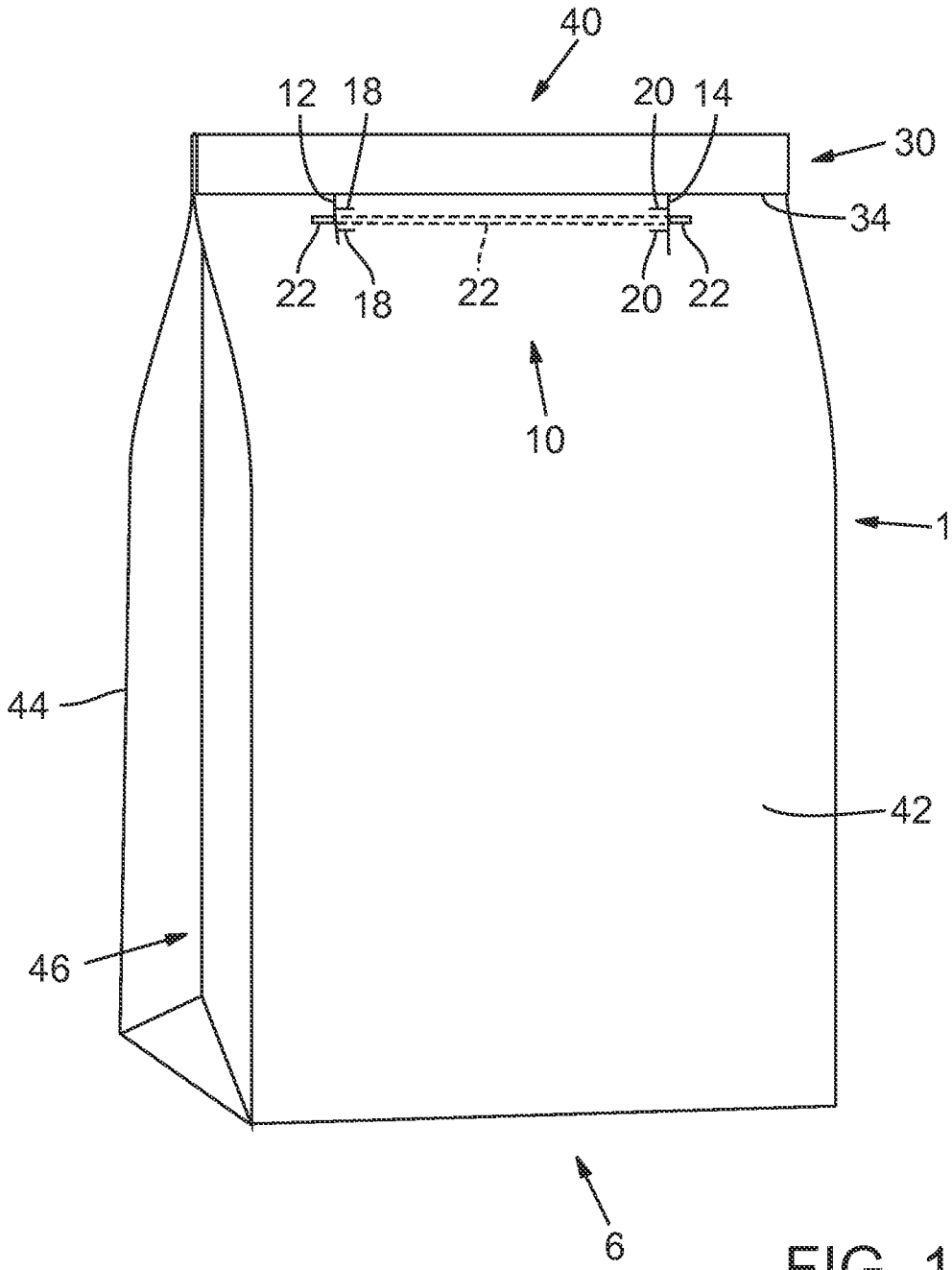
FIG. 1 is a perspective view of a multi-layer bulk material bag that has been filled and closed, and which incorporates an easy open apparatus according to the present invention.

With reference to FIGS. 1 and 2, the block bottom bag 1 is generally defined by a closed upper end 40, a closed lower end 6 that is formed into a block bottom closure, a front panel 42, rear panel 44 and side gussets 46, only one of which is shown in the perspective view of FIG. 1.

In FIG. 2 it may be seen that bag 1 has 4 layers; specifically, an outer paper layer 2, an adjacent middle paper layer 3, a next adjacent inner paper layer 4 and a next adjacent plastic liner 5 that defines the interior of the bag. As noted, bag 1 has a closed end 6 that is formed into a block bottom closure. In FIG. 2 the bag 1 is empty and the upper end is thus open; the open end is identified with reference number 7. The rear or back panel 44 of bag 1, that is, the panel on the rear side of the bag in the view of FIG. 2, has a stepped back flap 30 that extends upwardly beyond the limit or upper front edge 32 of the front panel 42. The innermost plastic liner 5 does not extend onto stepped back flap 30 but instead is coextensive with the upper front edge 32 of front panel 42. An adhesive 9 such as hot melt glue is applied to the inner facing surface of stepped back flap 30. It will be appreciated that the basic structure of the bag 1 insofar as the extended back flap 30 is concerned is conventional and to close the open end, the back flap 30 of rear panel 44 is folded over the front edge 32 of the front panel 42 and glued onto the front panel, as shown in FIG. 1.

The easy-open apparatus 10 according to the present invention is embodied in a pair of spaced apart and vertically extending slits 12 and 14 that are cut through the outer paper layer 2 of front panel 42 in bag 1 and which thus extend along the longitudinal axis of the bag (direction X in the figures), also known as the bag axis. The slits 12 and 14 define an opener flap or opener panel 16 (e.g., FIGS. 2 and 3—referred to herein as "panel 16" for brevity). The outer paper layer 2 is adhered to the middle paper layer 3 around the periphery of the panel 16 with, for example, small dots of glue 8 that are deposited between the two layers 2 and 3 outwardly of the slits 12 and 14 and along the bottom edge of the panel 16 where it folds down to make a flap. Glue 8 may also be deposited between layers 2 and 3 outwardly of the slits 12 and 14 near the upper edge 32 of front panel 42 as shown in FIG. 2.

FIG. 3 illustrates the next sequential step in adding the easy open apparatus 10 to bag 1 during manufacture. A pair of small slits 18 and 20 that extend transverse to the bag axis X are formed in each lateral side of flap 16, as shown in FIG. 2. As detailed in FIG. 4 and as explained below, these slits 18 and 20 form notches that accommodate the easy open tape 22 that is applied across opener panel 16 between the slits 18 and 20. The slits 18 and 20 are optional. In FIG. 4 the easy open tape 22 has been applied to panel 16. The easy open tape 22 may be glued to the panel 16 or may be adhered to the panel with a self-adhesive side included with the tap. Tape 22 is long enough that at least one lateral end (and preferably both lateral ends as shown in the drawings) extends outwardly beyond the lateral edge of flap 16. The tape 22 is a plastic or fiber material that is resilient and strong—the tape itself is strong enough to not break or tear when used as indicated herein.

With reference now to FIG. 5, a section of glue 24 is next applied to middle paper layer 4 in the area inwardly and beneath the outer lateral edges of panel 16 along slits 12 and 14. Matching glue sections 26 may also optionally be applied to the lateral edges of panel 16 so that when the panel is folded upwardly, closed as shown in FIG. 6, panel 16 is adhered to the underlying middle paper layer 3. The glue sections 26 adhere the opener flap 16 to the underlying adjacent paper layer along the side edges of the flap but the center major portion of the flap 16 is not adhered to the underlying paper layer.

Turning to FIG. 6, installation of the easy open apparatus 10 to bag 1 is finished and the empty bag is ready to be shipped to a consumer for filling. In the embodiment of FIG. 6, both of the opposite lateral ends of tape 22 are exposed past the edges of panel 16 that are defined by slits 12 and 14 so that the tap 22 is exposed to the outside of the bag.

A bag 1 with an easy-open apparatus 10 is filled and closed by the end user as usual. That is, as described above, after the bag is filled with the bulk material that is intended for the bag, the stepped back flap 30 of rear panel 44 is folded forwardly over the front edge 32 of the front panel 42 of bag 1 so that the adhesive 9 on the flap 30 faces the paper layer 2 of front panel 32 along the upper edge 32. The folded-over flap is then adhered in place—if the adhesive 9 is a hot melt adhesive, heat is applied to the folded-over region to activate the glue. When this is done, as illustrated in FIGS. 6 and 1, the stepped back flap 30 is folded over such that the outermost edge 34 of back flap 30 is adhered to panel 16 but the back flap 30 does not cover the portion of panel 16 where tape 22 is adhered to the inner-facing surface of the flap—that is, the area defined by the slits 18 and 20.

To open the filled and closed bag 1, the user grasps one of the exposed ends of tape 22 and pulls it outwardly away from the bag, thereby tearing the outer paper layer 2 across the panel 16. When easy open apparatus 10 includes the notches formed by paired slits 18 and 20 cause the initial tear of the paper to be neat and the tear follows essentially the same width of the distance between the slits as the tape 22 is pulled across the panel. Once the tape has been pulled all of the way across the panel 16 and removed, a "pocket" or "handle" is formed that the user may grasp to tear the bag open. More specifically, when the panel 16 is torn across the width of the panel, the user may insert his or her hand into the opening formed when the panel is torn, then tear the bag by pulling upwardly (in the X direction) to tear the remaining layers of the bag.

While the present invention has been described in terms of a preferred embodiment, it will be appreciated by one of ordinary skill that the spirit and scope of the invention is not limited to those embodiments, but extend to the various modifications and equivalents as defined in the appended claims.

The invention claimed is:

1. An opener for a multi-wall bag having a closed bottom end, an open top end and a front panel and opposed rear panel, the bag defining a bag axis extending from the closed end to the open end and the multi-wall bag having an outer paper layer and an adjacent layer, comprising:

an opener panel in the front panel defined by first and second spaced apart slits in the outer paper layer extending from an upper edge of the front panel along the bag axis, said opener panel having opposed first and second side edges defined by said first and second spaced apart slits and said opener panel having an inner-facing surface;

a first and second pair of transverse spaced apart slits in the outer paper layer of the front panel, each slit of each pair of said transverse spaced apart slits extending transverse to the bag axis and to a respective one of the opposed first and second side edges of said opener panel;

a strip of tape adhered to the inner-facing surface of the opener panel and extending completely across the opener panel in the direction transverse to the bag axis such that opposite ends of said tape extend beyond the first and second opposed side edges of said opener panel, said tape adhered to the inner-facing surface of said opener panel between each slit of each pair of said transverse spaced apart slits extending transverse to the bag axis;

wherein said opener panel is adhered to said adjacent layer with said opposite ends of said strip of tape exposed.

2. The opener according to claim 1 wherein said first and second spaced apart slits in the outer paper layer extend from the upper edge of the front panel along the bag axis and only partially along said front panel to thereby define said opener panel.

3. The opener according to claim 2 wherein said opener panel is adhered to said adjacent layer with adhesive applied only adjacent said first and second spaced apart slits such that a central portion of said opener panel is not adhered to said adjacent layer.

4. The opener according to claim 3 wherein said adjacent layer is paper.

5. The opener according to claim 1 including adhesive between said outer paper layer and said adjacent layer around the perimeter of said opener panel outwardly of said opener panel.

6. The opener according to claim 5 including adhesive between said outer paper layer and said adjacent layer outwardly of said first and second spaced apart slits and extending across said front panel.

7. The opener according to claim 1 including adhesive between said outer paper layer and said adjacent layer around the perimeter of said opener panel outwardly of said opener panel.

8. The opener according to claim 1 wherein the rear panel has a stepped upper edge section that extends beyond the said upper edge of said front panel, and wherein said stepped upper edge section is folded over said upper edge of said front panel and adhered thereto.

9. The opener according to claim 8 wherein when said stepped upper edge section of said rear panel is adhered to said front panel said stepped upper edge section covers at least a portion of said opener panel but does not cover said strip of tear tape.

10. A method of forming a multi-wall bag having an opener, the bag defined by an outer layer and an adjacent layer and the bag having a closed bottom end, an open top end, a front panel and opposed rear panel, the bag defining a bag axis extending from the closed end to the open end, comprising the steps of:

a) forming a bag having a front panel and opposed rear panel;

b) cutting a pair of opposed and spaced apart slits in the outer layer of the front panel to define flap in the front panel, said opposed and spaced apart slits extending from an upper edge of the front panel along the bag axis, and said flap having opposed first and second side edges defined by said slits and said flap having an inner-facing surface;

c) adhering a strip of tape to the inner-facing surface of the flap, so that said tape extends completely across the flap in the direction transverse to the bag axis such that opposite ends of said tape extend beyond the first and second opposed side edges of said flap;

d) adhering the inner-facing surface of said panel to the adjacent layer with said opposite ends of said tape exposed.

11. The method according to claim 10 including the step of cutting first and second pairs of slits in each of the opposed first and second side edges of the flap, each slit of each pair extending transverse to the bag axis and to a respective one of the opposed first and second side edges.

12. The method according to claim 11 including the step of adhering the tape between each slit of said transverse slits.

13. The method according to claim 12 including the step of closing the open end by folding over a stepped edge of said rear panel onto said front panel and adhering said stepped edge to said front panel.

14. The method according to claim 13 wherein said stepped edge of said rear panel is adhered to said flap.

15. The method according to claim 14 wherein said stepped edge is not adhered to said tape.

16. An opener for a multi-wall bag having a bottom end, a top end and a front panel and opposed rear panel, the bag defining a bag axis extending from the bottom end to the top end and the bag having an outer layer and an adjacent layer, comprising:

a flap in the front panel defined by first and second spaced apart slits in the outer paper layer extending from an upper edge of the front panel and parallel to the bag axis, said flap having opposed first and second side edges defined by said first and second spaced apart slits and said flap having an inner-facing surface;

a tear tape extending along the inner-facing surface of the flap and extending completely across the flap in the direction transverse to the bag axis such that opposite ends of said tear tape extend beyond the first and second opposed side edges of said flap;

wherein said flap is adhered to said adjacent layer with said opposite ends of said strip of tear tape exposed.

17. The opener of claim 16 including first and second pairs of spaced apart slits in the outer layer of the front panel, each slit of each pair of said spaced apart slits running transverse to the bag axis and extending to a respective one of the opposed first and second side edges of said flap.

18. The opener of claim 17 in which the tear tape is adhered to the inner-facing surface of said flap between each slit of each pair of spaced apart transverse slits.

19. The opener of claim 18 in which the flap is adhered to the adjacent layer along the opposed first and second side edges of said flap.

20. The opener of claim 19 in which a center portion of said flap is not adhered to the adjacent layer.

* * * * *